United States Patent [19]

Cohn et al.

[11] Patent Number: 4,486,276

[45] Date of Patent: Dec. 4, 1984

[54] METHOD FOR SUPPRESSING HYDROGEN FORMATION IN AN ELECTROLYTIC CELL

[75] Inventors: Johann Gunther E. Cohn, West Orange; Otto J. Adlhart, Newark, both of N.J.

[73] Assignee: Engelhard Corporation, Iselin, N.J.

[21] Appl. No.: 305,059

[22] Filed: Sep. 24, 1981

Related U.S. Application Data

[62] Division of Ser. No. 232,348, Feb. 6, 1981, abandoned.

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 4,191,618 3/1980 Coker et al. ..... 204/98

4,260,469 4/1981 McIntyre et al. ..... 204/265

OTHER PUBLICATIONS

The Electrochemical Society (Report); 159th Meeting: Abstract No. 418; p. 68; May 10–15, 1981.

Annual Report II of Diamond Shamrock Corp. (period of Oct. 1, 1978–Sep. 30, 1979) entitled: "Oxygen Electrode for Energy Conversion and Storage" (Contract EC-77-C-02-4146); pp. A6–A8, A18 (FIG. 1) and A19 (FIG. 19).

*Primary Examiner*—R. L. Andrews

[57] ABSTRACT

A method of operating an electrolytic cell in which cathodic hydrogen formation is suppressed by contacting the catalytic cathode with air or other oxygen-containing gas. The cells are of two types: (1) those in which a membrane is present as a distinct body to seperate the anode from the catalytic cathode; and (2) those in which the catalytic cathode and membrane are in combination as a single body; both of which types contain an ion permeable membrane to divide the said cell into an anolyte zone containing aqueous anolyte and a catholyte zone containing aqueous catholyte and a catalyst. The method of this invention provides for passing current through said anolyte and said catholyte while contacting said catalyst with an oxygen-containing gas to eliminate the formation of hydrogen gas. When alkali metal halide solutions are employed, halogen gas is evolved at the anode and alkali metal hydroxide is produced at the cathode.

4 Claims, 4 Drawing Figures

METHOD FOR SUPPRESSING HYDROGEN FORMATION IN AN ELECTROLYTIC CELL

This is a Division of application Ser. No. 232,348 filed Feb. 6, 1981, now abandoned.

This invention relates to catalytic electrodes for use in electrolytic cells.

More specifically, this invention relates to a chlor-alkali cell which employs air or other oxygen-containing gas to depolarize the cathode. This depolarization prevents the formation of hydrogen at the cathode and thereby improves the electrical efficiency of said cell.

The catalyst may be in juxtaposition with an ion-permeable membrane or it may be affixed to the surface of said membrane. The catalyst may also be affixed to the surface of a porous support or barrier which is physically separated from said membrane.

Alkalis such as sodium and potassium hydroxides have been produced by the electrolysis of aqueous alkali metal chloride solutions as, for example, brine with alkali being formed at the cathode, chlorine being formed at the anode and hydrogen, frequently considered a waste product, also being formed at the cathode. The production of hydrogen is uneconomical in that additional energy is required without providing a value equal to that expended in its production. Moreover, it can be a safety hazard.

Attempts have been made at developing cells which improve electrical efficiency by minimizing power consumption including depolarization of the cathodic process; however, no one of these developments achieves an optimal depolarization of the cathode or optimal elimination of unwanted hydrogen. These developments are summarized in the Background.

BACKGROUND

Electrolytic cells have been developed which utilize ion-exchange membranes for the selective migration of ions therethrough under the influence of a DC potential. Typical of these are the cells disclosed in U.S. Pat. No. 3,124,520 and 3,262,868 to Juda et al. These Patents describe cell systems in which porous electrodes are wetproofed by attaching solid ion exchange membranes to their surfaces. However, to separate anolyte and catholyte a cation exchange membrane is fixed between the electrodes and said electrodes are spaced apart from the membrane. Both Patents describe cells which utilize paired combustible and oxidant electrodes, including oxygen electrodes for the production of caustic and chlorine. Oxygen or air is utilized as a depolarizer in membrane cells employing porous cathodes.

U.S. Pat. No. 3,963,592 to Lindstrom describes a chloralkali electrolytic cell which is directed primarily to supplying gaseous hydrogen to the anode where it is oxidized to hydrogen ions. These ions are then caused to react with chloride ions at the anode to form hydrochloric acid as the product instead of chlorine. This Patent also describes the specific nature of the porous anode. The cells employed may include airdepolarized cathodes; however, no structures are disclosed different from those in the other cited art on air-depolarized cathodes for chlor-alkali cells.

U.S. Pat. No. 3,117,034 to Tirrell discloses a fuel gas electrode which utilizes a cation-permeable membrane and an anode which is intimately and physically in contact with said membrane. There is no teaching of a chlor-alkali cell in which an electrolyte is electrochemically converted into a new species which, in turn, must be kept apart from the bulk electrolyte. Indeed, the catholyte in this Patent is the acid solution which separates the membrane from the cathode.

U.S. Pat. No. 4,039,409 to LaConti also discloses a catalytic anode for use in an electrolytic cell for gas concentration and generation comprising a reduced alloy of platinum and ruthenium. The cell of this Patent comprises a pair of electrodes on either side of an ion-permeable membrane. Oxygen gas is generated at the catalytic anode.

U.S. Pat. No. 3,926,769 to Gritzner discloses an electrolytic cell which utilizes a diaphragm for the production of alkali metal hydroxides and gaseous chlorine. This Patent describes, with reference to the embodiment of FIG. 1, the air depolarization of a cell cathode in which the diaphragm is spaced apart from the catalyzed cathode by an appreciable distance over the catholyte zone resulting in a considerable power loss.

U.S. Pat. No. 3,923,628 to Gritzner covers an electrolytic brine cell in which the anode and cathode are spaced apart from one another and separated by a diaphragm. An oxidizing gas is brought into contact with the cathode for the purpose of depolarizing it and bringing under control the formation of hydrogen gas. However, it appears from the mixed results in Tables I-III and the specific embodiments that the depolarization procedure does not uniformly improve cell efficiency or minimize hydrogen gas formation. Indeed, Examples 1-33 of this Patent do not even mention hydrogen gas control.

In this Gritzner reference (U.S. Pat. No. 3,923,628), the air or oxygen used for depolarization purposes is pumped into a compartment partially defined by the cathode and it is then summarily withdrawn. The operating pressures for this procedure are not disclosed. Accordingly, there is no disclosure of means for achieving measurable contact between the oxygen-containing gas and the cathode.

THE INVENTION

A new and improved cell for producing halogen gas and alkali metal hydroxide is provided.

In its broadest aspect this invention covers an electrolytic cell in which the cathode is contacted with an oxygen-containing gas so as to inhibit the formation of hydrogen gas. The cathode consists essentially of a catalyst which is either in contact with a current carrying material or supported on a current carrying material.

More specifically, this invention relates to a novel cell comprising an (a) ion-permeable membrane which divides the cell into an anolyte zone which contains an anode in an aqueous anolyte and a catholyte zone containing a cathode in an aqueous catholyte; (b) means for passing current through said anolyte and said catholyte; (c) a catalyst system selected from the group consisting of: (1) a catalyst positioned in said catholyte in juxtaposition with said membrane; (2) a catalyst affixed to the surface of said membrane, said catalyst facing onto a porous barrier with a conductive spacer interposed therebetween, said spacer having one surface in juxtaposition with said catalyst and a second surface in juxtaposition with the barrier facing said catalyst; (3) a catalyst affixed to a porous support facing said membrane with a spacer material interposed therebetween, said spacer having one surface in juxtaposition with the catalyst and a second surface in juxtaposition with the membrane facing said catalyst; and (4) a catalyst affixed to a conductive screen which is interposed between said membrane and a porous barrier; (d) means for effecting contact of air or other oxygen-containing gas with said catalyst to depolarize the reaction in the catholyte zone; and (e) means for recovering the products of electrolysis.

The cells of this invention have several cathode configurations. According to one embodiment the catalytic cathode and membrane are separate bodies. In cells of this type the said membrane and said catalytic cathode may be in juxtaposition (ie , their surfaces may be in contact with one another) or, alternatively, they are physically separated from one another.

A second embodiment relates to cells in which the membrane is not separate from the catalytic cathode, instead, the said catalytic cathode is attached to the membrane so that together they constitute a single entity and share a common surface.

In each embodiment the catholyte is fed to the cell as a continuously flowing film or layer over the catalyst surface or across the area of juxtaposition of said catalytic cathode and said membrane. During this occurrence air or other oxygen-containing gas is brought into contact with the partially hydrophobic and partially hydrophilic surface of said catalytic cathode so as to depolarize the reaction in the catholyte zone and thereby eliminate any substantial formation of hydrogen gas. The resulting products are recovered by suitable means.

DESCRIPTION OF THE DRAWINGS

This invention will now be described by reference to the Drawings.

PREFERRED EMBODIMENTS

Figure 1:
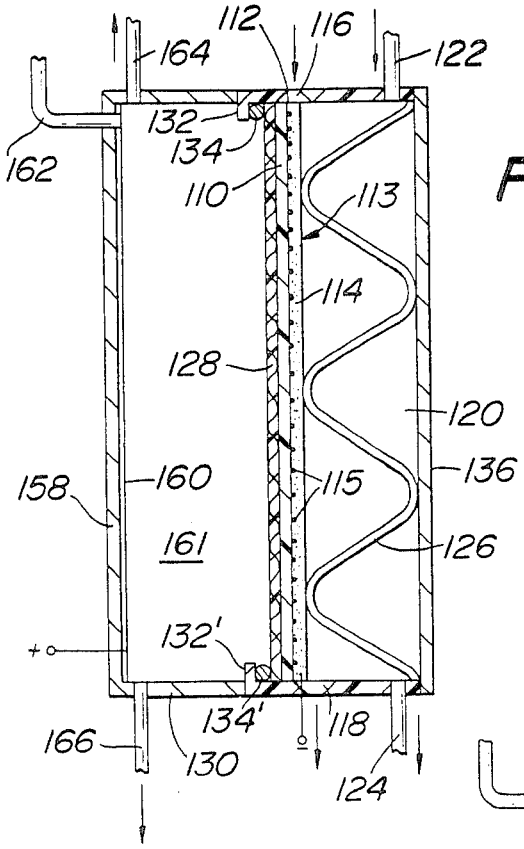
FIG. 1 is a schematic view of a cell wherein the catalyst is affixed to a support and a membrane is in juxtaposition with said support.
Figure 1A:
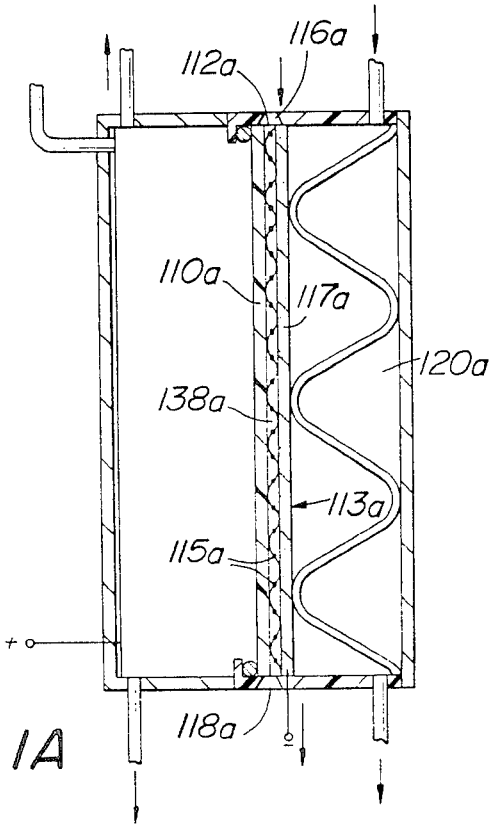
FIG. 1A is a schematic view of a cell wherein the catalyst is affixed to a conductive screen and a membrane is in juxtaposition with said screen.
Figure 2:
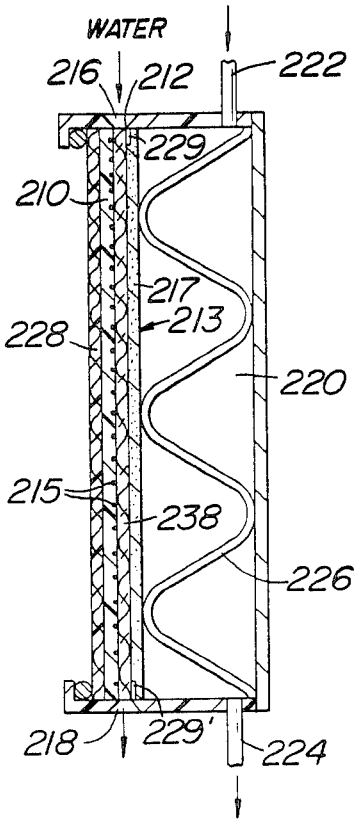
FIG. 2 is a schematic diagram of the cathodic section of a second cell in which the catalyst is affixed to the surface of an ion permeable membrane.
Figure 3:
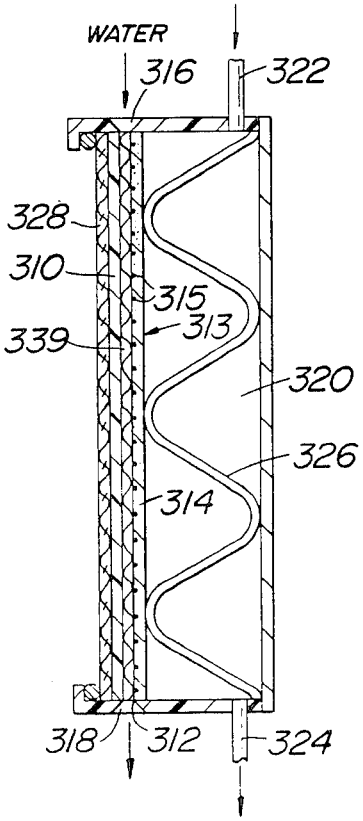
FIG. 3 is a schematic view of the cathodic section of a cell in which the catalyst is affixed to the surface of a porous hydrophobic barrier and the membrane is separated from said catalyst by a thin spacer arrangement.

FIG. 1 illustrates the operation of the cell of this invention and alternative features thereof. FIGS. 1A, 2 and 3 have the same last two digits as those of the corresponding parts shown in FIG. 1.

In FIG. 1 the cell of the present invention is shown to have an ion-permeable membrane which separates the anolyte zone from the catholyte zone. Membranes useful in this invention are any of those diaphragms and membranes known in the art which are permeable to at least alkali metal ions. Among those suitable are asbestos-containing diaphragms formed from asbestos sheets and sheets of other materials which are permeable to at least alkali metal ions.

Preferably, the membrane is a cation exchange membrane of the type known to the art for such uses. One suitable sulfonic acid type material is perfluorosulfonic acid polymer with high chemical and thermal stability which is permeable to positively charged ions and essentially impermeable to negatively charged ions and water molecules. One such preferred perfluorosulfonic acid polymer is available from E. I. du Pont De Nemours & Co., Inc. under the Trademark Nafion. With a polymeric membrane of this type, a fluorocarbon polymer backbone is negatively charged by essentially immobile sulfonic acid groups. In the assemblies described in this specification current is transported through the membrane by alkali metal ions.

Thus, the cells of the present invention can operate with ion-permeable membranes of the type which permit the passage of water therethrough as in the case of asbestos-type diaphragms or which do not permit the passage of water as in the case of ion-exchange membranes of the perfluorosulfonic acid polymer type. Each of these type membranes has its advantages and the ultimate choice depends upon the type of cathode employed and the economics of a particular industrial operation. However, it is generally preferable to employ ion-exchange type membranes which are essentially impervious to water because the alkali metal hydroxide product can be of a higher concentration and a higher degree of purity than can be obtained using the asbestos-type diaphragms.

The cell utilizes a cathode comprised of a supported layer of catalyst. In conventional systems the presence of water at the catalyst surface and the presence of alkali metal ions in solution results in the formation of hydrogen and alkali metal hydroxide in accordance with equation (1):

$$Na^+ + H_2O + e^- \longrightarrow Na^+ + OH^- + \tfrac{1}{2}H_2 \qquad (1)$$

By contrast, the process of this invention avoids any significant formation of hydrogen gas by contacting the cathodic catalyst with air or other oxygen-containing gas. The effect of this contacting step is to depolarize the reaction at the cathodic catalyst and substantially eliminate hydrogen buildup as shown in equation (2):

$$Na^+ + \tfrac{1}{2}H_2O + \tfrac{1}{4}O_2 + e^- \longrightarrow Na^+ + OH^- \qquad (2)$$

Several types of catalysts can be employed in this invention. The alkaline catholyte is less corrosive than acid and, therefore, non-precious metal catalysts as well as precious metal catalysts can be utilized.

In accordance with FIGS. 1 and 3 the cathodes are comprised of a porous support with a hydrophobic barrier to the air supply, that is, the cathode must be sufficiently porous so as to allow the said gas to reach the catalyst surface; however, at the same time the cathode must also be hydrophobic so that the alkali metal containing solution which comes into contact with the active catalyst side of the cathode cannot pass through the said cathode and into the chamber from which the air or oxygen emanates.

This invention will now be described in detail by reference to the Figures which depict a cathode module of a typical brine cell.

FIG. 1 illustrates an embodiment in which an ion-permeable membrane 110 is juxtaposed with a supported catalyst or cathodic catalyst identified generally as 113 comprised of a porous and electrically-conductive substrate 114 and a catalyst component 115 which functions as the cathode. The catalytic component 115 may be deposited onto the electrically-conductive substrate 114 or it may be deposited on a carrier which is in intimate contact with substrate 114. The cathodic catalyst 115 can be flushed with aqueous liquid supplied through port 116. The aqueous liquid collects the alkali metal hydroxide as it is formed at the catalyst surface and carries it out of the porous supported catalyst structure 114 by means of exit port 118. Where the ion-permeable membrane is of the type which permits the passage of water therethrough port 116 is not required; however, the port 118 for withdrawing said aqueous alkali hydroxide solution is required.

The cathode can be any material or composite which is capable of conducting sufficient current to the catalyst where the reaction can occur. In the particular embodiment shown in FIG. 1, the porous catalyst support is desirably unitary with the catalyst. In this type of structure, the cathode can be any material or composite capable of: (1) allowing air or other oxygen-containing gas to permeate into it to reach the catalyst and to permit residual gases out of the pore structure; (2) exhibiting the proper balance of hydrophilic and hydrophobic properties so as to permit aqueous liquid to permeate or reach the catalyst but prevent flow through the rear side of the cathode; and, (3) conducting sufficient current to permit reaction to occur at a practical rate. The porous supported catalyst 113, that is, the cathode shown in FIG. 1, is partially hydrophilic and partially hydrophobic on the surface closest to the membrane 110 and is highly hydrophobic on the surface furthest from membrane 110. The relative degree of hydrophilicity hydrophilic material such as graphite dispersed within a hydrophobic binder material such as polytetrafluoroethylene along the thickness of the catalyst support 114. This can be accomplished, for example, by applying varying quantities of particulate graphite and polytetrafluoroethylene upon a surface in successive layers and sintering the resulting, layered compsite of graphite and polytetrafluoroethylene under the appropriate conditions to obtain the desired porosity for the support 114.

The degree of porosity of the support 114 will depend upon a number of factors including the thickness of the catalyst layer, the rate at which aqueous liquid is brought into contact with the catalyst layer and the rate at which oxygen-containing gas is supplied through the porous support 114 for contact with the aqueous liquid and the catalyst to effect depolarization of the cathode. As shown in FIG. 1, an air chamber 120 is supplied with air or other oxygen-containing gas through inlet 122. Air can be withdrawn through outlet 124 as desired for process control. The pressure of the air is maintained within the chamber 120 at a pressure sufficient to force it within the pores of the support 114 effective to bring it into contact with the catalyst supported therein. It is neither necessary nor desired, however, to actually create a flow of air through the supported catalyst member. The air is simply supplied under suitable pressure to make it available for reaction with the aqueous catholyte at the solid catalyst surface to effect what is believed to be a three-phase boundary conversion of the oxygen at the catalyst surface.

Preferably the support 114 will be more porous at the surface furthest from the membrane 110 to permit lower resistance to the flow of air into the support, but it must also be highly hydrophobic at this surface so as to prevent the flow of aqueous liquid through the support and into the air chamber 120. According to one embodiment of the invention, the supported catalyst structure 113 may have a total thickness of about 1/4 of an inch with the catalyst layer comprising on the average of from about 0.001 to about 0.025 inches, and preferably from about 0.001 to about 0.005 inches. The entire support will be bound together by a suitable polymeric material which is substantially hydrophobic by itself or with treatment and is capable of being formed into a cohesive support material. Preferably, the polymeric material will be polyethylene or polytetrafluoroethylene and will be made conductive throughout by the use of a conductive material such as graphite, carbonized fiber, porous metal, metal fiber, or like structures. The degree of hydrophilicity will be increased from the surface furthest from the membrane 110 toward the surface closest to the membrane 110. The catalyst may be applied to the supporting material in any suitable manner as, for example, by depositing onto the support surface facing the membrane 110 an aqueous suspension of catalyst particles 115 to provide a complete catalytic unitary structure such that after sintering or otherwise bonding the particulate material into a cohesive structure, the supported catalyst represents a continuous conductive layer. Thus, for example, the catalyst can be applied directly to the conductive material. The method of depositing the catalytic material in the preparation of a catalyzed electrode is described in U.S. Pat. No. 3,425,875.

As shown in FIG. 1, a metallic spring 126 or other tensioning member can be used to maintain a constant compression of the supported catalyst 113 against the membrane 110. This metallic spring 126 can also be employed to optionally supply current to the supported catalyst 113 which, with the applied catalyst, functions as the cathode, with the current being supplied through the supported catalyst 113 by means of the conductive material dispersed therethrough. On the opposite side of the membrane 110 there is positioned a non-conductive screen 128 or other support member to maintain the normally non-self-supporting membrane in its proper position. The screen 128 is a barrier which may be ceramic in nature or, alternatively, it may be constructed from a suitable plastic as, for example, a polyethylene plastic such as Teflon.

The whole arrangement of membrane 110, supported catalyst 113 and retaining members 126 and 128 are held within housing 130 which contains inwardly depending non-conducting flanges 132 and 132' which hold seals 134 and 134' against screen 128 to seal the catholyte zone 112 from the anolyte zone 161. The seals 134 and 134' are most desirably constructed from a plastic material such as Teflon. The rear wall 136 of housing 130 can comprise a conductive anode made of a suitable material where bipolar operation is desired. Typical of the suitable anode materials are activated or catalyzed titanium or tantalum. The base metal, which is preferably titanium, is activated by coating or plating it with a suitable material such as the platinum group metals, for example, platinum, platinum alloys, ruthenium dioxide, platinum-iridum alloys, and the like.

The anolyte zone 161 is formed by membrane 110 and anode surface 160 of housing member 158. This inner surface is coated with an active material so that it can function as an anode. A solution of alkali metal chloride is fed into the cell via line 162 and the chlorine gas thus generated and spent brine are emitted via lines 164 and 166, respectively. If the membrane 110. is water permeable then the residual brine solution is discharged with the alkali hydroxide solution generated at cathode 113 and line 166 is not required.

While the embodiment of FIG. 1 has been shown with supported catalyst 113 comprising a unitary porous structure which performs the various functions of supporting the catalyst, providing a space for the product alkali metal hdyroxide to continuously flow from the cathode surface, carrying current, functioning as cathode and providing a hydrophobic backing member adjacent the air chamber 120 to permit the passage of air to contact the catalyst while preventing the flow of aqueous liquid into the air chamber 120, it is fully within the contemplation of the present invention to provide separate structures to accomplish these functions.

Thus, in one alternative embodiment a catalyst is coated onto or incorporated within a foraminous body such as a sheet of carbon fibers, graphite or the like and it is positioned directly against the membrane surface 110 where it may be secured by suitable support means. The passage of product alkali metal hydroxide from the reaction site can be facilitated by providing a porous catalyst support.

The support for the catalyst will be conductive as well as foraminous. Thus, the catalyst preferably will be coated onto or incorporated within a foraminous body or a thin porous supporting substrate, such as a screen, expanded metal, a sintered metallic or other conductive material support, or a sheet of carbon fibers or graphite and the like. When a metal screen is employed, it is preferably prepared from nickel, steel or an equivalent metal support material on whose surface the catalyst can be deposited. Thus, the substrate material must be inert to the catholyte or alkali metal hydroxide produced in the cell and it can be catalytically active itself or include any one of a number of catalyst materials on the surface thereof such as platinum, cobalt-aluminate, palladium and alloys or mixtures of platinum or palladium with other precious or base metals. Adherence of these metals to the substrate can be enhanced and the desired degree of waterproofing or hydrophobicity can be attained by the aid of a binder such as polytetrafluoroethylene, polyhexafluoropropylene or other polyhalogenated ethylene or propylene derivatives. When a screen support is utilized as the substrate it can comprise an 80-mesh U.S. standard size, or any similar suitable support. Also suitable as a thin, porous supporting substrate is carbon fiber, graphite or the like. According to this embodiment a sheet of catalyzed, porous carbon paper or the like can be employed.

According to another variation of this embodiment, the catalytic composite can comprise a mixture of carbonaceous binder material and carbon supported platinum as a catalyst. Platinum or palladium black, as they are known in the art, can be utilized as well as silver black, and other such materials in which the "black" material generally has a U.S. standard mesh size range of less than about 300. Where a catalyzed, porous carbon paper is employed, the carbon sheet will typically have a thickness of from 0.01 of 0.02 inches and it can be treated by impregnating it with a dilute emulsion of polytetrafluoroethylene and heating to about 300° C. to consolidate the catalyst onto the supporting structure.

Where it is desired to employ a separate sheet of hydrophobic material to separate the supported catalyst from the air chamber 120, any suitable non-wetting sheet material can be employed. The sheet is made non-wetting to prevent any liquid within the cathode from passing through the sheet and into the air chamber 120. This backup sheet can comprise materials such as waterproof carbon, waterproof asbestos, polytetrafluoroethylene, or other such water repellant materials which will nevertheless permit the flow of air or oxygen therethrough. This barrier is preferably conductive, but can be non-conductive where other means are supplied to assure proper current supply to the cathode.

According to another variation on this embodiment as shown in FIG. 1A, a screen **138*a* or other conductive structure is used to support the catalyst 115*a* and provided current to the supported catalyst shown generally as 113*a*. In addition to conducting current the screen 138*a* provides sufficient space between barrier 117*a* and membrane 110*a* to permit the continuous flow of product alkali metal hydroxide from the catalyst surface in catholyte zone 112*a*. Aqueous liquid added via inlet port 116*a* flushes alkali metal hydroxide from catholyte zone 112*a* through outlet port 118*a*. In this embodiment, a separate waterproofed barrier 117*a* of the type hereinbefore described is required. Where desired, sealing rings of the type employed to seal the outer periphery of the edge of the waterproofed backing member and the housing in the area of the air chamber 120*a*** may be used.

Another embodiment of this invention is illustrated by the cathode configuration of FIG. 2. In this embodiment the catalyst 215 is affixed to the surface of an ion-permeable membrane 210 and the supported catalyst is shown generally as 213. This membrane is supported on the anolyte side by screen 228. A porous hydrophobic barrier 217 prevents the flow of water or brine solution from the catalyst side of the system to the air chamber 220 while, at the same time allowing air or other oxygen-containing gas to permeate it and come into contact with said catalyst. A conductive screen or conductive porous material 238 is juxtaposed between membrane 210 and barrier 217 to serve both as a spacer and to supply current to the cathodic catalyst and to provide a channel for the flow of water which may be added via port 216. A spring 226 or other tensioning member provides compression against barrier 217 and maintains it in position against flanges 229 and 229'. Air or other oxygen-containing gas is supplied to the air chamber 220 via inlet 222 and said gas is withdrawn through outlet port 224 for process control. The air is supplied under such pressure as is necessary to force it through the pores of barrier 217 and bring it into contact with catalyst 215. Concurrently, if the membrane is impervious to liquid then water is provided through port 216 to provide reaction water and flush alkali metal hydroxide from the catalyst surface in catholyte zone 212 through exit port 218. Where the ion-permeable membrane is of the type which permits the passage of water therethrough, the introduction of aqueous fluid via port 216 for flushing the supported catalyst is not required; however, port 218 for withdrawing the aqueous alkali hydroxide solution is required. In a variation of this embodiment the conducting spacer and the membrane are in the form of a unitary body, for example, by affixing the spacer to the membrane or by partially imbedding the spacer into the membrane.

FIG. 3 illustrates a cathode system where catalyst particles 315 are affixed to the surface of a porous barrier 314 to afford a supported catalyst identified generally as 313. A spacer 339 as, for example, a screen or sheet of porous material is in juxtaposition with the catalyst particles 315 and provides a channel for the water which is added via port 316 or which passes through the membrane 310. Aqueous liquid supplied through inlet port 316 flushes the alkali metal hydroxide from the catalyst surface in catholyte zone 312 and through port 318. Membrane 310 is in juxtaposition with the other side of spacer 339 on the catholyte side of the cell. Screen 328 supports membrane 310 on the anolyte side of said cell.

The porous support 314 must be conductive whereas spacer 339 is preferably comprised of non-conductive materials such as plastic to avoid hydrogen discharge which may otherwise occur at high electrode potentials. Suitable conductive structures for porous support 314 include metal screens or carbon sheets.

The porous support 314 is also partly hydrophobic and partly hydrophilic with increasing hydrophobicity toward the side which faces onto air chamber 320. Accordingly, the side of porous support 314 which faces onto chamber 320 must be of such hydrophobicity as to prevent the flow of liquid into said chamber. Alternatively, a separate porous barrier may be interposed between cathode 313 and air chamber 320. Air or other oxygen containing gas is supplied to air chamber 310 through inlet port 322 and it is withdrawn through outlet port 324 as desired for control of cell pressure. The pressure is maintained at the level necessary to force air or oxygen-containing gas through the pores of the support 314 and into contact with the catalyst 315 without creating a flow of air through said barrier. The metallic spring 326 maintains a constant compression on porous support 314 but it may also be used to optionally supply current to the catalyst 315.

This invention will now be illustrated by reference to the following Example.

EXAMPLE

An electrolytic cell is employed having the configuration shown in FIG. 3. The circular cathode has an active area of 10 $cm^2$ and it is made of a porous carbon paper substrate coated with a thin film of active platinum. The catalyst carrying zone of said carbon paper substrate is made partially hydrophobic by impregnation with Teflon while the remainder of the carbon paper substrate is made fully hydrophobic by impregnation with Teflon.

A disc of porous graphite is placed behind said carbon paper. The activated side of said carbon paper substrate faces an asbestos membrane with a thin plastic spacer screen interposed and it is pressed against said membrane by means of a flexible stainless steel screen and a spring secured within the housing of an air plenum chamber made of steel. The air plenum chamber has an air inlet and air outlet at opposite sides.

The housing of the air plenum chamber also serves as a current conduit to the catalyzed carbon paper via the interposed graphite disc, screen and spring. The asbestos membrane is supported on the side facing the anolyte by a rigid plastic screen and it is sealed by a rubber gasket held in a protruding flange at the extension of the cylindrical wall of the plenum chamber housing which has been made nonconductive by coating with Teflon. A drain is provided in the cathode compartment just underneath the carbon paper to withdraw product solutions of caustic product.

The cell has an anolyte zone containing an activated titanium anode. The cell is operated at a feed rate of about 16 ml per hour of a sodium chloride solution containing 300g. sodium chloride per liter at a current density of 100 $A/ft^2$ *at a temperature of* 80° C. Air is passed through the air plenum chamber of the cathode compartment at a rate of about 2.3 liters per hour, which is about twice the stoichiometric amount. Product chlorine gas is removed at a rate of about 0.5 liters per hour and about 16 ml per hour are withdrawn from the cathode compartment of a solution containing about 100g. sodium hydroxide per liter. No appreciable evolution of hydrogen is detected.

It should be understood by those skilled in this art that other cathode configurations can also be assembled in accordance with the teachings of this invention while remaining within the scope of said invention as defined by the claims.

What is claimed is:

1. A method for operating a cell for electrolysis of aqueous alkali metal chloride solutions, said cell comprising: an anode; a barrier membrane which is permeable to oxygen but impermeable to water, spaced from but substantially parallel to said anode; a catalytic cathode located between said anode and said barrier membrane; an ion-permeable membrane between said anode and said catalytic cathode closely adjacent to said cathode; means for removing caustic from the cathode by passing an aqueous liquid between said ion-permeable membrane and said barrier membrane and contacting said aqueous liquid with said catalytic cathode; and means for passing an oxygen-containing gas through said barrier membrane and into contact with said catalytic cathode;

said method comprising the steps of:

supplying an aqueous alkali metal chloride to said anode;

flushing said catalytic cathode with an aqueous liquid by passing said aqueous liquid between said ion-permeable membrane and said barrier membrane, and passing oxygen containing gas through said barrier layer and into contact with said catalytic cathode.

2. The method of claim 1 wherein said alkali metal chloride is sodium choloride.

3. The method of claim 2 wherein said oxygen containing gas is air.

4. The method of claim 1 wherein said oxygen containing gas is air.

* * * * *

UNITED STATES PATENT AND TRADEMARK OFFICE

CERTIFICATE OF CORRECTION

PATENT NO. : 4,486,276

DATED : December 4, 1984

INVENTOR(S) : Johann Gunther E. Cohn and Otto J. Adlhart

It is certified that error appears in the above-identified patent and that said Letters Patent are hereby corrected as shown below:

In Column 10, line 51 delete [choloride] and replace with --chloride--.

Signed and Sealed this

*Fourteenth* Day of *May 1985*

[SEAL]

*Attest:*

DONALD J. QUIGG

*Attesting Officer* *Acting Commissioner of Patents and Trademarks*